United States Patent [19]

Lewandowski

[11] Patent Number: 4,529,852

[45] Date of Patent: Jul. 16, 1985

[54] ELECTRICAL APPLIANCE INTERLOCK SWITCH

[75] Inventor: Raymond Lewandowski, Mount Prospect, Ill.

[73] Assignee: Cherry Electrical Products Corporation, Waukegan, Ill.

[21] Appl. No.: 512,930

[22] Filed: Jul. 12, 1983

[51] Int. Cl.[3] ..... H01H 9/00; H01H 3/16

[52] U.S. Cl. ..... 200/50 A; 200/1 B; 200/51.09; 200/61.62

[58] Field of Search ..... 219/10.55 C, 10.55 B; 200/1 R, 1 A, 5 R, 1 TK, 50 A, 61.62, 51.09, 51.1, 51 R, 80 R, 1 B

[56] References Cited

U.S. PATENT DOCUMENTS

| | | | |
|---|---|---|---|
| 3,742,162 | 6/1973 | Wasemann | 200/61.62 |
| 3,865,097 | 2/1975 | Robinson | 126/197 |
| 3,924,085 | 12/1975 | Stone | 200/61.62 |
| 3,967,088 | 6/1976 | Horiuchi | 200/50 A X |
| 4,101,750 | 7/1978 | Doner | 200/50 A X |
| 4,160,885 | 7/1979 | Ellicott et al. | 200/1 R |
| 4,233,478 | 11/1980 | Stahl et al. | 200/51.09 |

FOREIGN PATENT DOCUMENTS

| | | |
|---|---|---|
| 448931 | 6/1936 | United Kingdom . |
| 486882 | 6/1938 | United Kingdom . |
| 590117 | 7/1947 | United Kingdom . |
| 632379 | 11/1949 | United Kingdom . |
| 1377001 | 12/1974 | United Kingdom . |

*Primary Examiner*—J. R. Scott

*Attorney, Agent, or Firm*—Willian Brinks Olds Hofer Gilson & Lione Ltd.

[57] ABSTRACT

An interlock switch used with an electrical appliance such as a microwave oven. The interlock switch includes a cantilevered common switch element, and two other switch elements mounted on opposite sides of the common switch elements. When the appliance door is closed, the common switch element makes contact with the switch elements on one side and breaks contact with the switch element on the other side.

13 Claims, 6 Drawing Figures

ELECTRICAL APPLIANCE INTERLOCK SWITCH

CROSS-REFERENCES TO RELATED APPLICATIONS

This application is related to co-pending U.S. patent application Ser. Nos. 512,928, 512,929 and 512,931 filed on July 12, 1983.

BACKGROUND OF THE INVENTION

This invention relates generally to electrical appliances and specifically to microwave ovens which have a frame defining a cooking chamber, and a door hingedly mounted to the frame. More particularly, this invention relates to such appliances which utilize an interlock switch, mounted in the door jamb, actuated by probe means extending from the door in alignment with the door jamb. The interlock switch permits the oven to be operated only when the oven door is fully closed and latched, thereby providing a highly desirable safety feature.

Interlock switches used for this purpose typically comprise two electrically coupled switches, both of which must be actuated in order for operating power to be passed to the oven. The value of such an interlock switch is, of course, reduced if one of the two electrically coupled switches becomes welded closed due to tampering, equipment malfunction or some spurous condition. If this occurs, actuation of the unaffected switch will be the only action necessary to allow operating power to be passed to the oven. This, of course, would defeat many of the safety benefits associated with a conventional interlock switch.

In an effort to overcome this problem, a fuse has been provided in the circuit one of the two electrically coupled switches. If that switch then becomes welded closed, the fuse will blow before operating power could be supplied to the oven. Though this circuitry appears to overcome some of the potential dangers associated with microwave oven operation, interlock switches are still subject to inefficiencies, relatively high costs, latent dangers and the like.

SUMMARY OF THE INVENTION

The present invention contemplates an improved interlock switch for use with an electrical appliance such as a microwave oven. The appliance comprises a frame defining a door jamb, a door mounted to the frame, and a probe mounted to the door in alignment with the door jamb.

The interlock switch comprises a housing mounted to the door jamb. Inside the housing there is provided a common switch element, a second switch element, and a third switch element. The common switch element has a first contact portion on one side and a second contact portion on the other side, the first contact portion being closer to one end of the common switch element than the other end, and the second contact portion being closer to the other end of the common switch element than the first end. The second switch element has a contact surface adapted to be movable into and out of contact with the first contact portion of the common switch element by operation of the probe, and the third switch element has a contact surface adapted to be movable into and out of contact with the second contact portion of the common switch element upon operation of the probe. This arrangement provides a more reliable, economicable, efficient, compact interlock switch than has been heretofore available.

BRIEF DESCRIPTION OF THE DRAWINGS

The preferred embodiment of the invention summarized above is shown in the accompanying drawings wherein.

DETAILED DESCRIPTION OF THE PREFERRED EMBODIMENT OF THE INVENTION

Figure 1:
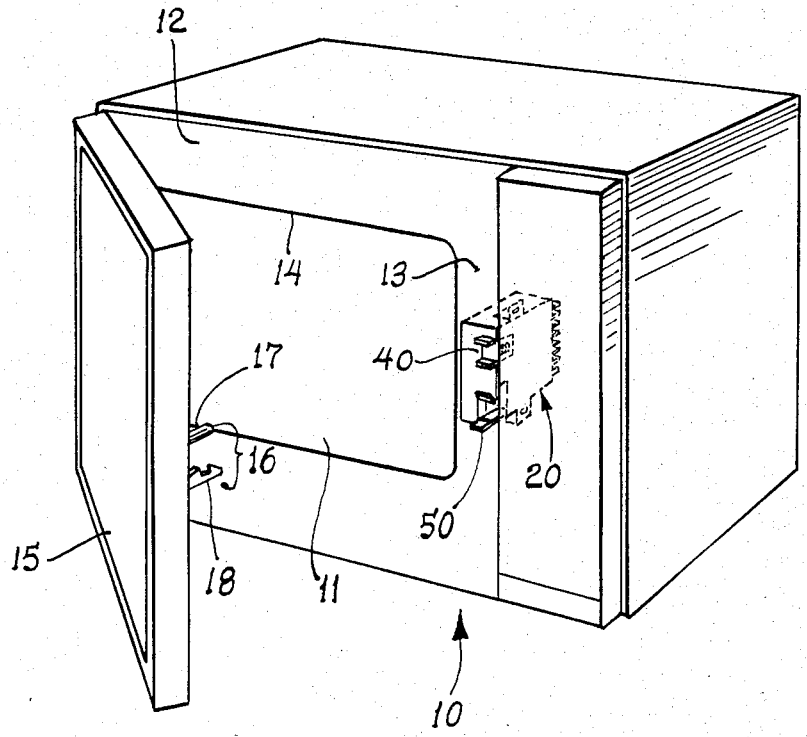
FIG. 1 is a schematic, perspective view of an electrical appliance incorporating the invention.

Referring now to FIG. 1 there is illustrated a preferred embodiment of the invention. In particular, there is illustrated an electrical appliance, such as a microwave oven 10, having a frame 12 defining a chamber 11 into which food to be heated by oven 10 is placed. Frame 12 further includes a door jamb 13 into which is mounted an interlock switch 20.

Oven 10 further includes an oven door 15 which is typically hingebly mounted to frame 12. Near the free end of oven door 15 there is mounted probe means 16, preferably in the form of a rigid pin member 17 and a movable latch pawl 18. Pin member 17 and latch pawl 18 are preferably aligned with door jamb 13, and in particular are aligned, respectively, with a first actuator 40 and a second actuator 50 associated with interlock switch 20. As explained in greater detail hereinafter, pin member 17 operates first actuator 40 as oven door 15 becomes partially closed, and latch pawl 18 operates second actuator 50, when oven door 15 is fully closed and latched.

Figure 5:
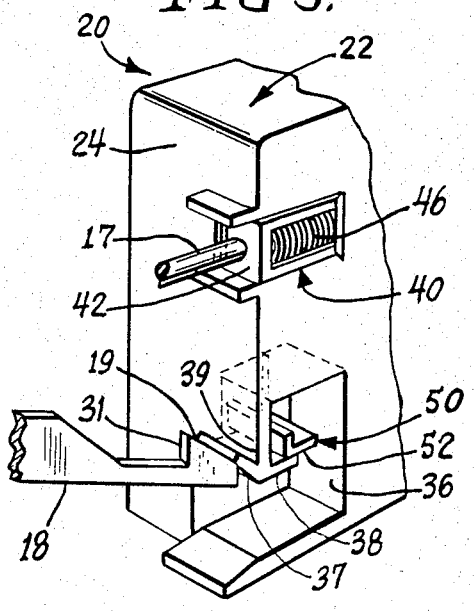
FIG. 5 is an enlarged, schematic, perspective of a portion of the appliance and the interlock switch shown in FIG. 1.
Figure 6:
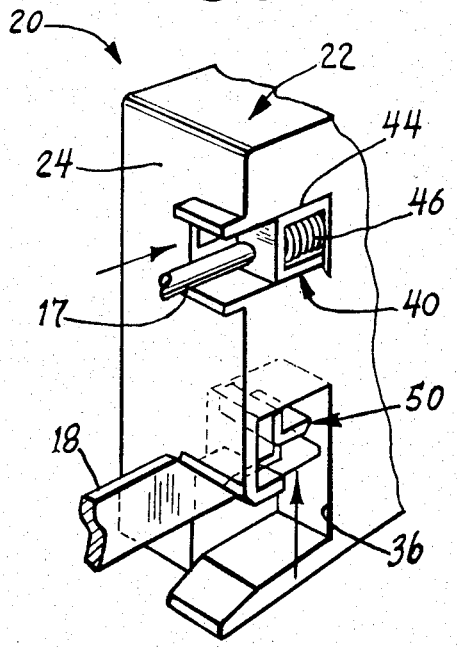
FIG. 6 is an enlarged, schematic, perspective view of the portion of the interlock switch shown in FIG. 5, but in an actuated condition.

The operation of probe means 16 in the form of pin member 17 and latch pawl 18 are shown best by referring to FIGS. 5 and 6. As oven door 15 closes, rigid pin member 17 abuts a contact face 42 of first actuator 40, thereby moving a slider 44 horizontally (see horizontal arrow in FIG. 6) against a coil spring 46. The movement of slider 44 causes actuation of several switch elements associated with interlock switch 20 in a manner explained in greater detail hereinafter.

Similarly, latch pawl 18 operates second actuator 50 when oven door 15 is fully closed and latched. Thus, still referring to FIGS. 5 and 6, interlock switch 20 comprises a housing 22 having a rear wall 24. Rear wall 24 defines a notch 36 and a latch 39 extending therein. Latch 39 has an angled face 37 and a horizontal face 38 adapted to be sequentially contacted by a latch surface 19 of latch pawl 18. When latch pawl 18 begins to advance into notch 36 in rear wall 24, during the closure of oven door 15, latch surface 19 is urged downwardly by angled face 37 of latch 39. As latch pawl 18 advances further into notch 36, latch surface 19 slides along horizontal face 38 of latch 39 until face 38 is aligned with a control 31 defined in latch pawl 18. When this occurs, latch paw 18 springs upwardly (see vertical arrow in FIG. 6), whereby oven door 15 is fully closed and latch pawl 18 becomes latched with latch 39. This action also causes latch surface 19 to engage a contact face 52 of actuator 50 to effect the operation thereof.

As shown in FIGS. 5 and 6, in this preferred embodiment, rigid pin member 17 and latch pawl 18 operate actuators 40,50 without actually entering the interior of housing 22 of interlock switch 20. Indeed, throughout the entire operation of switch 20, actuators 40,50 isolate the outside environment of switch 20 from the interior of housing 22. As a result, door probe wear particles and other spurious material cannot readily enter housing 22 and perhaps interfere with the operation of the various components therein. Further, this arrangement greatly minimizes the likelihood that access to the interior of housing 22 can be gained via an external implement (such as a knife or screwdriver) through tampering, carelessness or accident.

Operation of actuator 50 by the latching of latch pawl 18 to latch 39 causes actuator 50 to move from the position shown in FIG. 5, to the position shown in FIG. 6. This, in turn, causes actuation of several switch elements associated with interlock switch 20 in a manner explained in greater detail hereinafter. From the foregoing description, however, it should be clear that the sequence of movement of actuators 40 and 50 is such that first actuator 40 is operated by rigid pin member 17 before oven door 15 is fully closed, but second actuator 50 is not operated by latch pawl 18 until oven door 15 is fully closed and latched.

Figure 2:
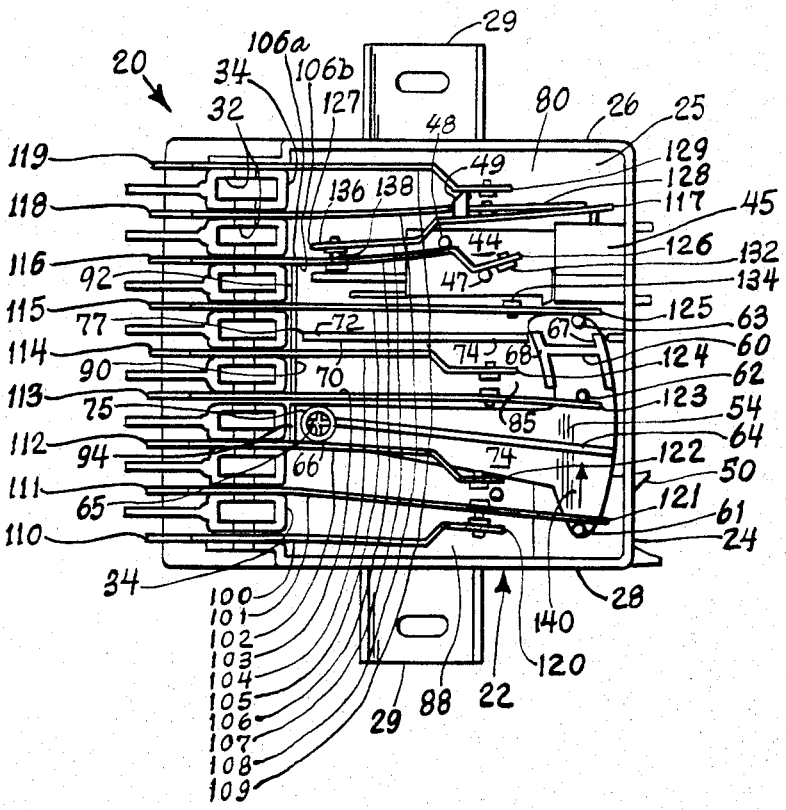
FIG. 2 is a schematic, plan view of the interlock switch used with the appliance shown in FIG. 1.
Figure 3:
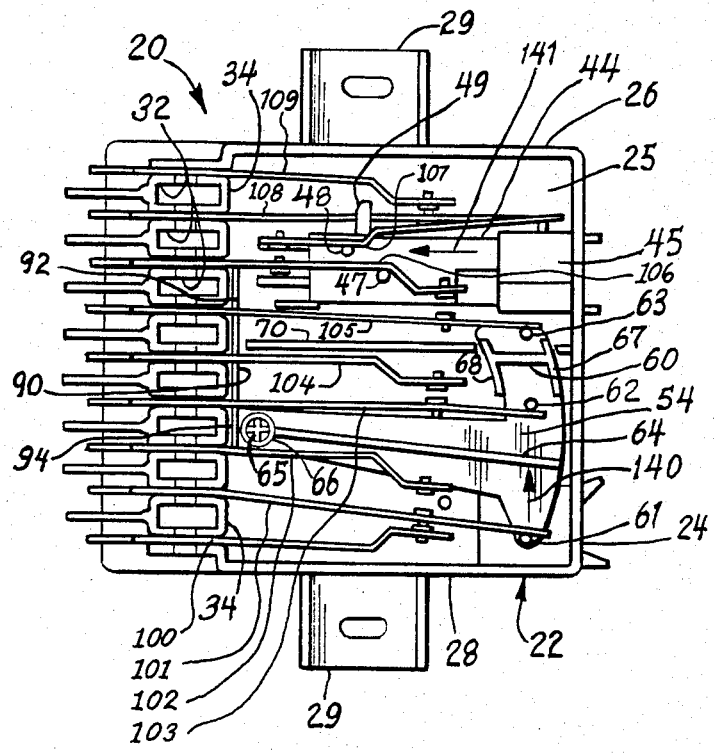
FIG. 3 is a schematic, plan view of the interlock switch shown in FIG. 2 in a partially actuated condition.
Figure 4:
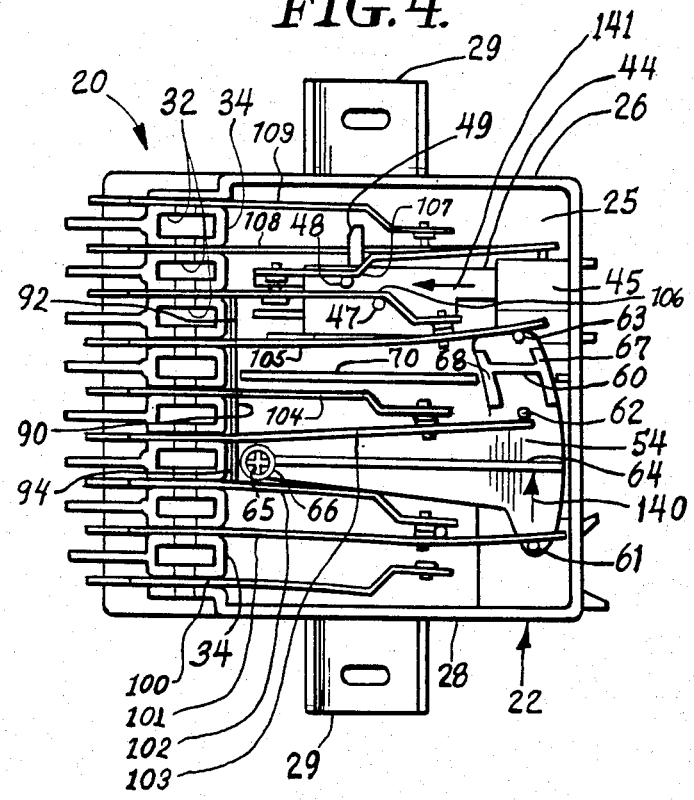
FIG. 4 is a schematic, plan view of the interlock switch shown in FIG. 2 in a fully actuated condition.

The specific components of interlock switch 20 and their operational sequence in response to the movement of actuators 40 and 50 is illustrated in FIGS. 2–4. In particular, FIG. 2 illustrates the position of the switch elements comprising interlock switch 20 when oven door 15 is open, FIG. 3 illustrates the position of those switch elements when oven door 15 is partially closed, and FIG. 4 illustrates the position of those switch elements when oven door 15 is fully closed and latched.

Referring now to FIG. 2, housing 22 of interlock switch 20 is shown to include, in addition to rear wall 24, a pair of side walls 26, 28 a bottom or base wall 25, and a plurality of anchoring fixtures 32 defining an interior front wall 34. Extending outwardly from side walls 26, 28 are a pair of mounting ears 29 which are used to facilitate the mounting of interlock switch 20 in door jamb 13 of oven 10.

Interlock switch 20 further includes a stationary barrier 70 which preferably comprises a rigid member extending upwardly from base 25 near the center of housing 22. Pivotally mounted to base 25 of housing 22 is a platform 54 having a movable barrier 60 extending upwardly therefrom along substantially the same line defined by stationary barrier 70 when oven door 15 is in the fully closed position of FIG. 4. A pair of substantially parallel flange members 67, 68 also extend upwardly from platform 54 intersecting, respectively, the opposite ends of movable barrier 60. Also extending upwardly from platform 54 are three rigid pins 61, 62 and 63 whose function will be explained hereinafter.

An additional moveable barrier 64, extending substantially parallel to stationary barrier 70 when oven door 15 is in the fully closed position of FIG. 4 also extends upwardly from platform 54. Additional barrier 64 terminates in a hub 66 which is mounted over a post 65 extending upwardly from base 25. Actuator 50 is preferably integrally formed with platform 54 near the end thereof opposite hub 66. Thus, movement of actuator 50, in response to movement of latch pawl 18, causes platform 54 to pivot about past 65. This movement of platform 54 causes a corresponding movement of pins 61, 62 and 63, movable barrier 60, and additional barrier 64.

Housing 22 further incorporates a slider guide 45 through which slider 44 can be moved back and forth in response to the operation of actuator 40 by rigid pin member 17. Extending upwardly from slider 44 is a pair of actuator pins 47, 48, and extending transversely from slider 44 is an actuator arm 49. The functions of actuator pins 47, 48 and actuator arm 49 will be explained hereinafter.

Mounted inside housing 22 of interlock switch 20 are a plurality of electrically conductive switch elements 100–109. Switch elements 100–106 and switch elements 108–109 have, respectively, fixed ends 110–116 and 118–119, substantially captivated between adjacent ones of anchoring fixtures 32, and (except for switch element 108) free ends 120–126 and 128–129.

Interlock switch 20 also includes an electrically conductive switch element 107 which is preferably integrally formed with switch element 108. Thus, in this embodiment, switch element 107 has a free end 127 and an interconnected end 117 which connects with an interconnected end 128 of switch element 108. Each of switch elements 100–109 is preferably mounted edgewise within housing 22 of interlock switch 20, so that they sometimes function as leaf springs, and are formed of electrically conductive material such as copper or the like.

In this preferred embodiment switch elements 100 and 101 form part of a circuit for an auxillary device such as a lamp (not shown), and are normally closed, i.e., in the "make" condition, when oven door 15 is in the open position of FIG. 2. Thus, the lamp in the circuit comprising switch elements 100 and 101 will be illuminated when oven door 15 is open.

Switch elements 101 and 102 preferably form part of a primary interlock circuit for microwave oven 10, and are normally open, i.e., in the "break" condition when oven door 15 is in the open position of FIG. 2. Thus, switch elements 101 and 102 prevent operating power from being supplied to microwave oven 10 as long as oven door 15 is open, converting to the "make" condition only when the door is fully closed and latched.

Switch elements 103 and 104 preferably form part of a logic circuit (not shown) which, in accordance with well known microwave oven operation, controls many of the oven's operating parameters and sequences. As shown in FIG. 2, switch elements 103 and 104 are normally in the "break" condition when oven door 15 is open, thereby rendering the logic circuitry inoperative at that time.

Switch elements 105 and 106 comprise the secondary interlock for microwave oven 10. As with the primary interlock defined by switch elements 101 and 102, switch elements 105 and 106 are normally in the "break" condition when oven door 15 is open, changing to the "make" condition only when oven door 15 is fully closed and latched.

Switch elements 106 and 107 form part of a monitoring circuit which includes a fuse (not shown), and are normally in the "make" condition when the oven door is open. In accordance with conventional interlock switch operation, if switch elements 106 and 107, and switch elements 105 and 106, are ever simultaneously closed, such as if a malfunction causes switch elements 105 and 106 to be welded together, the fuse will blow, thereby preventing operating power from being supplied to oven 10 even if all other conditions for proper oven operation have been satisfied. Switch element 106, sometimes referred to herein as a common switch element, has a monitor side 106*a* and an interlock side 106*b*. A part 138 of switch element 106 on the monitor side 106*a* is adapted to contact a portion 136 of switch element 107 near the free end 127 thereof when oven door 15 is open. On the other hand, a part 132 on the interlock side 106*b* of switch element 106 is adapted to contact a portion 134 of switch element 105 when oven door 15 is fully closed and latched.

Finally, switch elements 108 and 109, which are normally in the "break" condition when oven door 15 is open, form part of a second auxillary circuit which may also include a lamp (not shown). In this preferred embodiment switch elements 108 and 109 are disposed lower in housing 22 than any of the other switch elements 100 through 107. In particular, switch elements 108 and 109 are located in a plane slightly above base 25 of housing 22, while switch elements 100 through 107 are located in a plane closer to the top of housing 22.

A buss 90, preferably comprised of an integrally formed segment 94 of switch element 102 and an integrally formed segment 92 of switch element 106 serves to electrically interconnect those two switch elements. For safety purposes, buss 90 is mounted edgewise in gaps 75 and 77, thereby being substantially captivated between interior front wall 34 on the one hand, and the forward end 72 of stationary barrier 70 and the forward end of movable barrier 64, i.e., hub 66 on the other hand. The segments 92, 94 comprising buss 90 are preferably formed by bending portions of switch elements 102 and 106 until the ends of the bent portions are in facing relationship. These ends of segments 92, 94 are then electrically interconnected in any conventional manner.

Stationary barrier 70 and movable barrier 60, along with portions of rear wall 24, side wall 26 and interior front wall 34, define a first compartment 80 within housing 22 of interlock switch 20. First compartment 80 serves to confine, within that compartment, any pieces of interlock switch 20 which, due to part failure, abuse, or manufacturing error, become broken off and loose inside housing 22. By isolating such broken off pieces in this manner, they cannot accidentally fall into a portion of housing 22 outside the boundaries of first compartment 80 and accidentally short circuit or interfere with other switch elements or components. For the same purpose, stationary barrier 70, movable barrier 60 and additional barrier 64, along with portions of rear wall 24 and interior front wall 34 define a second compartment 85, isolated from other portions of housing 22. Similarly, additional barrier 64, along with portions of rear wall 24, side wall 28 and interior front wall 34 define a third compartment 88, isolated from other portions of housing 22.

The operation of interlock switch 20 can now be explained. When oven door 15 is open, the switch elements of interlock switch 20 take the configuration shown in FIG. 2. In this configuration, pin 61 provides a force on switch element 101 substantially in the direction of arrow 140. Similarly, pin 63 provides a force on switch element 105 substantially in the same direction as arrow 140. On the other hand, pin 62 provides a force on switch element 103 in the direction opposite arrow 140. Thus, when actuator 50 is operated by latch pawl 18 (FIG. 6) the force opposing the movement of actuator 50 is substantially reduced. In particular, if the magnitude of the force at each of pins 61, 62 and 63 is substantially equal, the combined force of pins 61, 62 and 63 opposing movement of actuator 50 is approximately one third that which it would be if the forces applied by all three pins 61, 62 and 63 were in the same direction as arrow 140.

As oven door 15 begins to close, the operation of rigid pin member 17 and actuator 40 takes effect. This, in turn, causes slider 44, and hence actuator pins 47, 48 and actuator arm 49, to move from the positions shown in FIG. 2 to the position shown in FIG. 3. Thus, switch elements 108 and 109 move from the "break" to the "make" position, while switch elements 107 and 106 move from the "MAKE" to the "BREAK" position. Further, switch element 106 moves closer to (but still does not contact) switch element 105.

When oven door 15 is fully closed, and latch pawl 18 is latched to latch 39 (FIG. 6), the switch elements change from the positions shown in FIG. 3 to the positions shown in FIG. 4. More particularly, switch elements 105 and 106 contact one another. Switch elements 103 and 104 move from the "break" to the "make" position, switch elements 101 and 102 move from the "break" to the "make" position, and switch elements 100 and 101 move from the "make" to the "break" position.

The interlock switch described herein, when used in connection with an electrical appliance such as microwave oven 10, provides many efficiencies, economies, and safety features. For example, the use of switch element 106 as a cantilevered common switch element adapted to contact switch element 107 on one side of switch element 106 and to contact switch element 105 on the other side of switch element 106, combines the advantages of reliability, efficiency, economy, and compactness in a single switch. Further, the use of stationary and movable barriers of the type described isolates any pieces of interlock switch 20 which, due to part failure, abuse, or manufacturing error, become broken off or loose inside housing 22. As such, these broken off pieces cannot accidentally fall into portions of housing 22 outside the boundaries of the compartments in which they are confined, and accidentally short circuit or interfere with other switch elements or components. Additionally, by captivating buss 90 in gaps 75 and 77, and forming it integrally from portions of switch elements 102 and 106, the chances of buss 90 breaking away and causing electrical or mechanical damage to the other components of interlock switch 20 is greatly reduced.

In view of the foregoing, the above described interlock switch, adapted for use with an electrical appliance such as a microwave oven, has numerous benefits and advantages not available heretofore. However, several modifications and embodiments of this switch, and its operating environment, which do not part from the true scope of the invention, will become apparent to those skilled in the art. Accordingly, all such modifications and embodiments are intended to be covered by the appended claims.

I claim:

1. An interlock switch for an electrical appliance having a frame means defining a door jamb, and a door mounted to said frame means comprising:

an interlock switch housing adapted for mounting to said door jamb;

first and second resilient, electrically conductive switch elements, mounted in said interlock switch housing, normally in electrical contact;

a third resilient, electrically conductive switch element, mounted in said interlock switch housing, normally in spaced relation out of electrical contact with said second switch element;

a first actuator, mounted to said housing, operatable with the closure of said door to flex said first switch element out of electrical contact with said second switch element, and to flex said second switch element to a new position closer to, but not into contact with, said third switch element;

and a second actuator, mounted to said housing, operatable with the closure of said door, to flex said third switch element into electrically conductive contact with said second switch element at said new position, whereby operation of both the first and second actuators is required to bring said second and third switch elements into electrically conductive contact.

2. The interlock switch defined in claim 1 further including a pair of electrically conducting switch elements, normally in an open circuit position, mounted in a plane beneath said first, second and third switch elements, movable, by the operation of said first actuator, into electrically conductive contact in a closed circuit position upon closure of said door.

3. The interlock switch defined in claim 2 wherein said first actuator includes;

a slider movable within a slide guide; and an actuator arm adapted to move said pair of switch elements from said open circuit position to said closed circuit position upon operation of said first actuator by closure of said door.

4. The interlock switch defined in claim 3 further including actuator pin means, mounted on said slider, adapted to flex said first and second switch elements from said closed circuit position to said open circuit position upon operation of said first actuator by closure of said door.

5. The interlock switch defined in claim 2 wherein one end of said first switch element is permanently connected to one end of one of said pair of switch elements normally in the open circuit position

6. The interlock switch defined in claim 1 wherein said first actuator is operable upon at least partial closure of said door and said second actuator is operable upon full closure of said door.

7. An interlock switch for an electrical appliance having probe means mounted to the appliance door, comprising:

a housing;

a plurality of resilient, electrically conductive switch elements mounted in said housing in substantial isolation from the environment outside said housing, at least one pair of said plurality of switch elements being normally in electrically conductive contact in a closed circuit position, and an additional one of said plurality of switch elements being normally in spaced relation out of electrical contact with said pair when the switch elements of the pair are in electrically conductive contact; and actuator means, at least a portion thereof being mounted outside said housing, said portion adapted to be urged at least partially inside said housing by said probe means during the closure of said door so that the probe means does not enter the housing, said actuator means thereby directly contacting at least one element of said plurality of switch elements thereby causing a change in the position of one or more of said plurality of switch elements including said at least one pair of switch elements and said additional one of said plurality of switch elements, to break the electrically conductive contact between said pair of switch elements and thereafter sequentially establish electrically conductive contact between said at least one element of said pair of switch elements and said additional one of said plurality of switch elements.

8. The interlock switch defined in claim 7 wherein said actuator means is biased against the force of said probe means.

9. The interlock switch defined in claim 8 wherein said actuator means is adapted to return to its original position upon opening of said door.

10. The interlock switch defined in claim 7 wherein said actuator means includes at least one contact face aligned with said probe means, and at least one other contact face aligned substantially perpendicular to the axis of motion of said probe means upon closure of said door, each such face adapted to be contacted by said probe means upon closure of said door, whereby said actuator means is prevented from causing a break in the electrically conductive connection between said pair of switch elements and from establishing an electrically conductive connection between said one element of said pair of switch elements, and said additional one of said plurality of switch elements, until said door is securely closed and latched.

11. The interlock switch of claim 10 wherein said probe means includes at least one rigid post adapted to engage said at least one contact face arranged to be aligned with said probe means, and at least one latch pawl adapted to engage said at least one contact face arranged to be aligned perpendicularly to the axis of motion of said probe means upon closure of said door.

12. An interlock switch for switching power to an electrical appliance including frame means defining a door jamb, a door mounted to said frame means, and probe means mounted to said door in alignment with said door jamb, comprising:

an interlock switch housing adapted to be mounted to said door and engageable by said probe means upon closure of said door;

a common switch element, mounted within said housing, said common switch element having a fixed end, a free end, a first contact portion on one side closer to said fixed end than said free end, and a second contact portion on an opposite side closer to said free end than said fixed end;

a monitor switch element, mounted within said housing substantially parallel to and adjacent said common switch element, having a portion for electrically conductively contacting said first contact portion of said common switch element when said door is open;

an interlock switch element, mounted within said housing substantially parallel to and adjacent said common switch element opposite said monitor switch element, said interlock switch element having a fixed end, a free end, and a contact surface closer to said free end than said fixed end, said contact surface being out of electrical contact with said second contact portion of said common switch element when said door is open and adapted to electrically conductively contact said second contact portion when said door is closed; and actuator means, movably mounted to said housing for initially engaging and moving under the influence of said first probe means and thereafter sequentially engaging and moving under the influence of said second probe means upon closure of said door, said actuator means, upon engagement by said first probe means having means for moving said monitor and common switch elements apart to break the electrically conductive contact between these elements, and for moving said common switch element to a predetermined position closer to but not in electrically conductive contact with said interlock switch element, further, said actuator means, upon engagement by said second probe means, having means for moving said interlock switch element so that said contact surface of said interlock switch element comes into electrically conductive contact with said second contact portion of said common switch element, the engagement of said actuator means by both said probe means sequentially moving the actuator means to establish electrical contact between said common and said interlock switch elements for applying electrical power to said appliance.

13. The interlock switch of claim 12 wherein said actuator means include a first actuator and a second actuator.

* * * * *